United States Patent [19]

Kalkipsakis

[11] Patent Number: 4,672,688

[45] **Date of Patent: * Jun. 9, 1987**

[54] FLEXIBLE CONTAINER WITH INTERNAL FILLING CHUTE

[75] Inventor: Charalambos G. Kalkipsakis, Hawthorn East, Australia

[73] Assignee: Wrightcel Limited, Victoria, Australia

[ * ] Notice: The portion of the term of this patent subsequent to Sep. 17, 2002 has been disclaimed.

[21] Appl. No.: 748,575

[22] Filed: Jun. 25, 1985

[30] Foreign Application Priority Data

Jun. 29, 1984 [AU] Australia ..... PG5771/84

[51] Int. Cl.[4] ..... B65D 30/24

[52] U.S. Cl. ..... 383/58; 222/92; 383/44; 383/66; 383/904

[58] Field of Search ..... 383/43, 44, 58, 66, 383/100, 103, 901, 904, 906; 222/92, 105, 107, 564, 566

[56] References Cited

U.S. PATENT DOCUMENTS

| | | | |
|---|---|---|---|
| 810,349 | 1/1906 | Rogers | 383/58 |
| 3,089,636 | 5/1963 | Swartz | 383/58 X |
| 3,209,804 | 10/1965 | Walker | 383/58 |
| 3,263,903 | 8/1966 | Waller et al. | 383/44 |
| 3,282,412 | 11/1966 | Corella et al. | 383/44 X |
| 3,322,327 | 5/1967 | Prall | 383/58 |
| 4,257,535 | 3/1981 | Mellett | 222/92 |
| 4,542,530 | 9/1985 | Thomas et al. | 383/66 |

FOREIGN PATENT DOCUMENTS

| | | | |
|---|---|---|---|
| 1238758 | 4/1967 | Fed. Rep. of Germany | 383/44 |
| 1411646 | 10/1968 | Fed. Rep. of Germany | 383/58 |
| 1441414 | 6/1976 | United Kingdom | 383/58 |

*Primary Examiner*—William Price
*Assistant Examiner*—Bryon Gehman
*Attorney, Agent, or Firm*—Bell, Seltzer, Park & Gibson

[57] ABSTRACT

The present specification relates to flexible containers having an aperture through which the container is filled or dispensed, the container having a flexible flap overlying the aperture so as to seal the container once filled. The container in accordance with the present invention is arranged such that the flap is attached to the container so as to form a chute by arranging two divergent weld lines on opposite sides of the aperture to assist in directing material into the container during filling.

2 Claims, 5 Drawing Figures

FLEXIBLE CONTAINER WITH INTERNAL FILLING CHUTE

This invention relates to an improvement in flexible containers of the kind used in storing and dispensing liquids or solid suspensions. In particular this invention relates to an improvement in the containers described in U.S. Pat. Nos. 4,542,530 and 4,257,535, assigned to the assignee of the present application.

Those U.S. patents disclose a flexible container which includes a filling aperture, defined by a collar which is also adapted to receive the dispensing tap for the container. To enable the filling aperture to be sealed a flap is provided to cover the aperture so that it can be heat sealed to the periphery of the aperture. This results in a sealed package which is only ruptured by the insertion into the collars of a dispensing tap which incorporates a spigot to break the flap sealing the aperture.

A difficulty encountered with the initial design was to ensure that the flap would be correctly located over the aperture during the heat sealing operation. This problem was overcome by heat sealing portions of the flap to the periphery of the aperture at selected positions on two sides of the aperture.

An example of this prior art construction is shown in FIGS. 1 and 2 of the drawings. A portion of the flexible container is shown FIG. 1. The container is formed of two walls 2 and 4 welded together at seam 3. The container is filled and dispensed through the aperture 7 which is defined by the gland 8. The wall 2 of the container is secured to the outer surface of the flange 9 of the gland 8 and the aperture is covered by the flap 5. This flap is heat sealed with small round seals 13 at a number of places around the outer circumference of the inner surface of the flange 9. The edge 12 of flap 5 is shown the schematic plan view of the aperture 7 in FIG. 2. The edge 14 of the flange 9 is also shown in FIG. 2. When the container is filled it is sealed by the heat seal at line 15.

Although this arrangement ensures that the flap is correctly located about the aperture, the presence of the flap restricts the flow of liquid through the aperture during filling. It is possible to obtain adequate filling speeds by increasing the pressure of the filling liquid on the flap. The presence of the flap also restricts the use of the container for solid suspensions such as pineapple crush.

It is an object of this invention to overcome these problems.

To this end the present invention provides a flexible container sealed about its edges, one wall of said container having an aperture through which the contents of the container can be passed for filling or dispensing, a collar mounted in said aperture said collar being adapted to receive means for dispensing the contents of said container and a flap located inside the container covering said aperture and having a heat sealable surface facing said collar and a non-heat sealable surface on the reverse side, said flap being attached to said container or collar so that under filling conditions the flap will form into a chute below said aperture to direct the contents into the container.

In a preferred embodiment the collar (or gland) has a large base flange and the flap is secured to it by two divergent heat seal welds at locations on opposite sides of the aperture. The welds form a chute which widens in a direction away from the center of the aperture.

Although the flap abuts the collar flange and the aperture in its prefilled state under filling conditions the flap and the collar flange will distend to form a funnel approximately perpendicular to the axis of the collar. The diameter of the funnel so formed is dependent on the position of the welds and these should be placed to ensure that the diameter is at least equivalent to that of the collar.

Some of the objects and advantages of this invention having been set forth above, other objects and advantages with become apparent in the detailed description of a preferred embodiment of this invention which follows, when taken in conjunction with the accompanying drawings, in which.

Figure 3:
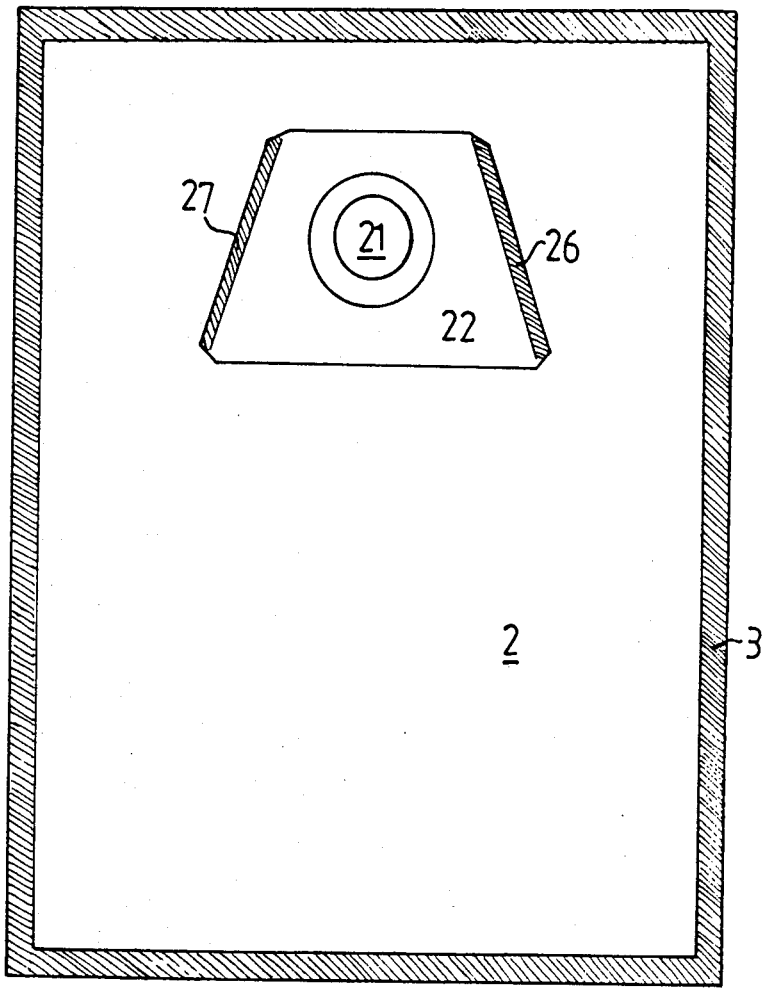
FIG. 3 is a plan view of a flexible container constructed in accordance with this invention.
Figure 4:
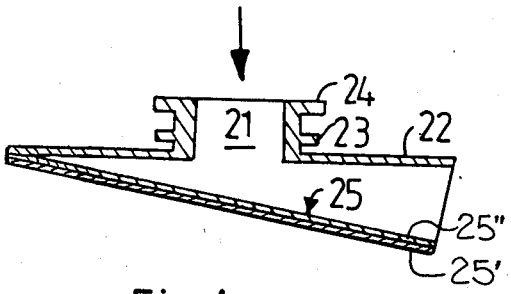
FIG. 4 is a sectional view of the collar member and flap member of the flexible container of this invention illustrated in FIG. 3 and shown in the configuration occurring during a fill operation.
Figure 5:
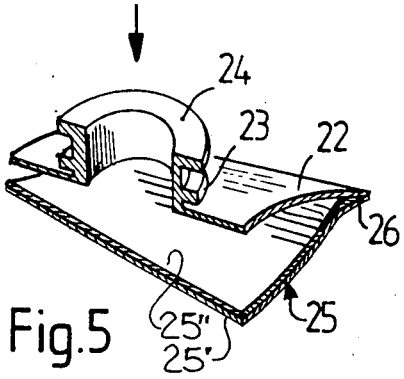
FIG. 5 is a perspective view of FIG. 4.

A preferred form of this invention is illustrated in FIGS. 3, 4 and 5 of the drawings in which FIG. 3 is a plan view of the collar and flap, FIG. 4 is a sectional view of the collar and flap during the fill operation and FIG. 5 is a perspective view of FIG. 4.

The collar 21 is a polyethylene cylinder having a base flange 22 and a support flange 23 and location flange 24. Alternatively the collar can be formed from a modified polyethylene such as polyethylene vinyl acetate. The collar is inserted into the aperture of the wall of the flexible container 2 which is heat sealed to the upper surface of base flange 22. The support flange 23 provides support for the container during filling when the collar is gripped and held below the filling nozzle. Usually the flexible containers are placed in a rigid box when filled and the collar is inserted through an aperture in a wall of the box and the wall locates between flanges 22 and 23 of the collar 21. A dispensing tap is then inserted into the collar 21.

The flap 25 is secured to the under surface base flange 22 by welds 26 and 27. The flap 25 abuts the flange 22 in the unfilled bag and after filling the flap is heat sealed by a circular weld about the periphery of the aperture of collar 21. Any two ply laminate which incorporates a non-heat sealing outer layer 25' such as polyester, nylon or metal foil, and a heat sealable inner layer 25' of polyethylene or modified polyethylene can be used for the flap 25.

The container may be formed from any flexible film or laminate, with or without a loose inner layer, which can be satisfactorily heat sealed to form a container.

Generally laminates are of two ply construction incorporating an outer barrier layer with the inner layer being polyethylene which may be modified to enhance its properties.

Sometimes a third layer of foil or a vacuum deposit of aluminium is sandwiched in the laminate to provide a barrier to gases, water vapour and light.

The loose inner layer is always polyethylene, either natural or modified.

During filling as shown in FIGS. 4 and 5 the pressure of the fluid passing through collar 21 and impacting on flap 25 distends the flap 25 and the flange 22 to form an elbow and spout which directs the flow of fluid into the interior of the container.

Figure 1:
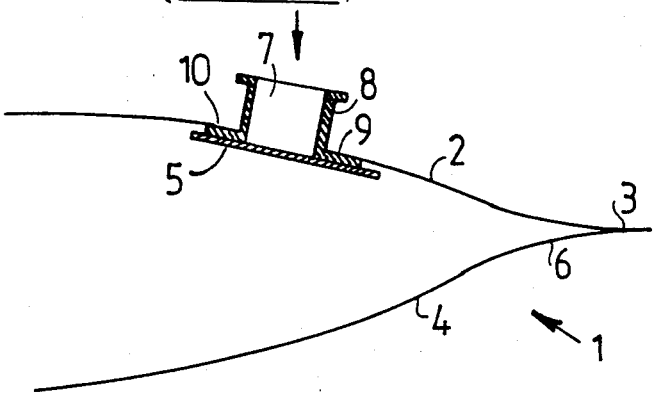
Fig.1 (PRIOR ART)
FIG. 1 is an illustration of a part of the prior art flexible container discussed above.
Figure 2:
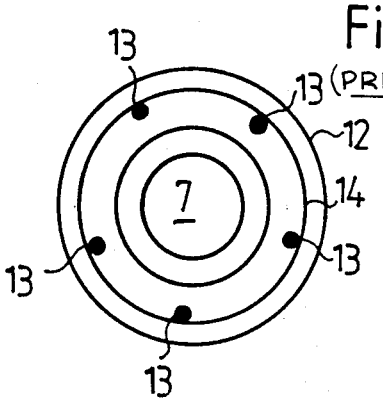
Fig.2 (PRIOR ART)
FIG. 2 is a bottom plan view illustrating the sealing regions of the flap member to the collar member of the prior art flexible container of FIG. 1 and which has been discussed above.

Unlike the construction shown in FIGS. 1 and 2 the flow rate is not restricted. An increase in filling speed from 1 liter per minute to 8.5 liters per minute has been achieved with the construction of this invention.

Liquid at 50,000 cps, will require a head pressure of 280 cm of water to obtain a flow rate of 1 liter/min with the conventional gland.

The new gland will achieve a flow rate of 6 liters/min at half the above head pressure (140 cm of water).

Using a liquid of 6,000 cps, and 280 cm of water head pressure a flow rate of 1.6 liters/min was obtained with conventional gland, whilst only 15 cm of water head pressure was required for the new gland to achieve the same flow rate.

Using liquids of 1 cps and 15 cm of water head pressure a flow rate of 1 liter/min was obtained with the conventional gland and 8.5 liters/min with the new gland.

Furthermore it is now possible to fill the container with a solids suspension in which the solid particles are up to $\frac{2}{3}$ of the internal diameter of the collar. The flap itself is no longer a restriction to the size of particles which can enter the container.

The claim defining the invention are as follows:

1. A flexible container of the type used for storing and dispensing liquids and solid suspensions, said container comprising:

flexible wall members sealed together around the peripheral edges thereof and defining an aperture in one of said wall members through which the contents of said container can be passed for filling or dispensing;

a collar member mounted in said aperture and being adapted to receive means for dispensing the contents of said container;

a flap member positioned inside said wall members of said container for covering said aperture and having a heat sealable surface on the side thereof facing said collar member and a non-heat sealable surface on the reverse side thereof; and at least two spaced divergent weld line means for attaching said flap member to said container on opposite sides of said aperture and for forming a divergent chute into said container which widens in a direction away from the center of said aperture to facilitate the filling of said container.

2. A flexible container, as set forth in claim 1, in which said flap member comprises a two ply laminate having said surface facing said collar member formed from polyethylene or modified polyethylene and said reverse surface formed from non-heat sealable film of polyester, nylon or metal foil.

* * * * *